US011251548B2

(12) United States Patent
Hung

(10) Patent No.: US 11,251,548 B2
(45) Date of Patent: Feb. 15, 2022

(54) ELECTRICAL TERMINAL ASSEMBLY AND ELECTRICAL CONNECTOR THEREOF

(71) Applicant: Dongguan Luxshare Technologies Co., Ltd, Dongguan (CN)

(72) Inventor: Yung-Chih Hung, Dongguan (CN)

(73) Assignee: DONGGUAN LUXSHARE TECHNOLOGIES CO., LTD, Dongguan (CN)

( * ) Notice: Subject to any disclaimer, the term of this patent is extended or adjusted under 35 U.S.C. 154(b) by 18 days.

(21) Appl. No.: 16/876,644

(22) Filed: May 18, 2020

(65) Prior Publication Data

US 2020/0280142 A1 Sep. 3, 2020

(30) Foreign Application Priority Data

Oct. 30, 2019 (TW) ..... 108214337

(51) Int. Cl.
*H01R 9/24* (2006.01)
*H01R 13/514* (2006.01)
*H01R 12/71* (2011.01)

(52) U.S. Cl.
CPC ..... *H01R 9/24* (2013.01); *H01R 13/514* (2013.01); *H01R 12/712* (2013.01)

(58) Field of Classification Search
CPC ... H01R 4/24; H01R 9/09; H01R 9/24; H01R 13/44; H01R 13/514; H01R 13/627; H01R 12/712; H01R 13/6467
USPC ..... 439/78, 79, 80, 83, 389–400, 404, 439/607–609, 676
See application file for complete search history.

(56) References Cited

U.S. PATENT DOCUMENTS 4,690,479 A * 9/1987 Hollyday ..... H01R 13/7195 439/101
4,891,019 A * 1/1990 Olsson ..... H01R 12/79 439/404
4,908,335 A * 3/1990 Cosmos ..... H01R 12/716 439/444
5,169,343 A * 12/1992 Andrews ..... H01R 13/6585 439/607.11
5,171,161 A * 12/1992 Kachlic ..... H01R 13/6275 439/352
7,744,408 B2 6/2010 Komatsu
(Continued)

FOREIGN PATENT DOCUMENTS

CN 1682414 B 5/2010
CN 203747183 U 7/2014
(Continued)

*Primary Examiner* — William H. Mayo, III
(74) *Attorney, Agent, or Firm* — Birch, Stewart, Kolasch & Birch, LLP

(57) ABSTRACT

An electrical terminal assembly includes a mounting block and one or more electrical terminals. The electrical terminal includes a terminal body and a first exposed section. The terminal body is embedded in the mounting block. The first exposed section is extended from the terminal body and protruding from the mounting block. The first exposed section further includes an interference part protruding from one side edge of the first exposed section. A protruding direction of the interference part is substantially perpendicular to an extension direction of the first exposed section. An electrical connector includes the electrical terminal assembly and a base accommodating the electrical terminal assembly.

18 Claims, 15 Drawing Sheets

(56) References Cited

U.S. PATENT DOCUMENTS

| | | | | |
|---|---|---|---|---|
| 8,323,049 | B2 | 12/2012 | Ngo | |
| 2016/0013508 | A1 * | 1/2016 | Martinchek | H01M 8/2404 429/469 |

FOREIGN PATENT DOCUMENTS

| | | | | | |
|---|---|---|---|---|---|
| CN | 102301537 | B | | 8/2014 | |
| CN | 206283014 | U | | 6/2017 | |
| CN | 206283046 | U | | 6/2017 | |
| CN | 206806561 | U | | 12/2017 | |
| CN | 206908021 | U | | 1/2018 | |
| CN | 207265268 | U | * | 4/2018 | H01R 12/71 |
| CN | 207265268 | U | | 4/2018 | |

* cited by examiner

ELECTRICAL TERMINAL ASSEMBLY AND ELECTRICAL CONNECTOR THEREOF

CROSS-REFERENCE TO RELATED APPLICATION

This non-provisional application claims priority under 35 U.S.C. § 119(a) to Patent Application No. 108214337 in Taiwan, R.O.C. on Oct. 30, 2019, the entire contents of which are hereby incorporated by reference.

BACKGROUND

Technical Field

This disclosure relates to an electrical terminal assembly and an electrical connector structure, in particular, to an electrical terminal assembly combining with plural electrical terminals and to an electrical connector having the electrical terminal assembly.

Related Art

An electrical connector, for example a connector on a circuit board for power or signal transmissions, generally includes an electrical-insulated base and plural electrical terminal pins. According to different transmissions requirement, the electrical terminal pins are also provided with different types.

An electrical terminal pin used for signal transmission usually has a smaller size, so as to increase the number of electrical terminal pins in one electrical-insulated base and meet the requirement for high-speed signal transmission. Under this configuration, the contact ends of the electrical terminal pins will be densely arranged in an array form.

A small-sized electrical terminal pin is not easy to be installed and fixed. As a result, the electrical terminal pin is usually configured in a needle-like shape to be inserted into the straight mounting hole of the electrical-insulated base. Furthermore, it is also difficult to have the small electrical terminal pin to have a bent configuration in which the mounting portion of the electrical terminal pin can be directly inserted into the soldering hole of the circuit board. As a result, the small-sized electrical terminal pin has to be wired for connecting to the circuit board.

SUMMARY

In order to solve the installation and fixation problems of the electrical terminals in electrical connector, this disclosure discloses an electrical terminal assembly that could combine plural electrical terminals into to one assembly to facilitate the installation and fixation of the electrical terminals in the electrical connector.

An electrical terminal assembly according to one embodiment of this disclosure comprises a mounting block and at least one electrical terminal. The at least one electrical terminal includes a terminal body and a first exposed section. The terminal body is embedded in the mounting block. The first exposed section is extended from the terminal body and protruding from the mounting block. The first exposed section further includes an interference part protruding from one side edge of the first exposed section. A protruding direction of the interference part is substantially perpendicular to an extension direction of the first exposed section.

An electrical connector according to one embodiment of this disclosure comprises a base and at least one electrical terminal assembly. The base includes a front surface, a rear surface, and an outer peripheral surface. The front surface is opposite to the rear surface. The outer peripheral surface is connected to the front surface and the rear surface. At least one installation trough is on the rear surface, and the at least one installation trough communicates with the front surface through an insertion hole. At least one guiding groove is provided in the insertion hole, and the at least one guiding groove is extended toward the front surface from a connection portion between the at least one installation trough and the insertion hole. The at least one electrical terminal assembly includes a mounting block and at least one electrical terminal. The at least one electrical terminal includes a terminal body and a first exposed section. The terminal body is embedded in the mounting block, and the first exposed section is extended from the terminal body and protruding from the mounting block. The first exposed section further includes an interference part protruding from one side edge of the first exposed section. A protruding direction of the interference part is substantially perpendicular to an extension direction of the first exposed section. The mounting block is received in the at least one installation trough. The first exposed section is inserted into the insertion hole. The interference part is embedded in the guiding groove.

Another electrical connector according to one embodiment of this disclosure comprises a base and at least one electrical terminal assembly. The base includes a front surface, a rear surface, and an outer peripheral surface. The front surface is opposite to the rear surface, and the outer peripheral surface is connected to the front surface and the rear surface. At least one installation trough is on the rear surface, and the at least one installation trough communicates with the front surface through an insertion hole. The at least one electrical terminal assembly includes a mounting block and at least one electrical terminal. The electrical terminal includes a terminal body and a first exposed section. The terminal body is embedded in the mounting block, and the first exposed section is extended from the terminal body and protruding from the mounting block. The first exposed section further includes an interference part protruding from one side edge of the first exposed section, and a protruding direction of the interference part is substantially perpendicular to an extension direction of the first exposed section. The mounting block is received in the at least one installation trough. The first exposed section is inserted into the insertion hole, and the interference part is abutted against an inner wall of the insertion hole.

In one or more embodiments of this disclosure, plural electrical terminals are combined together by the mounting block to form a single electrical terminal assembly. The electrical terminal assembly can be used for the installation of plural electrical terminals in the base at one time. Moreover, the configuration of the interference part is helpful to guide, limit, and fix the first exposed section of the electrical terminal in the insertion hole, thereby facilitating the fixation of the electrical terminal assembly. Furthermore, in one or more embodiments, the mounting block and the base are combined with each other through guiding structures, so that the fixation of the electrical terminal assembly in the electrical connector can be further improved. The mounting block provides a fixing and supporting effect on the electrical terminals, effectively avoiding the deformation of the electrical terminals, and helpful for subsequent alignment of the electrical terminals and the through holes when the electrical connector is installed on the circuit board.

BRIEF DESCRIPTION OF THE DRAWINGS

This disclosure will become more fully understood from the detailed description given herein below for illustration only, and thus not limitative of this disclosure, wherein.

DETAILED DESCRIPTION

Figure 1:
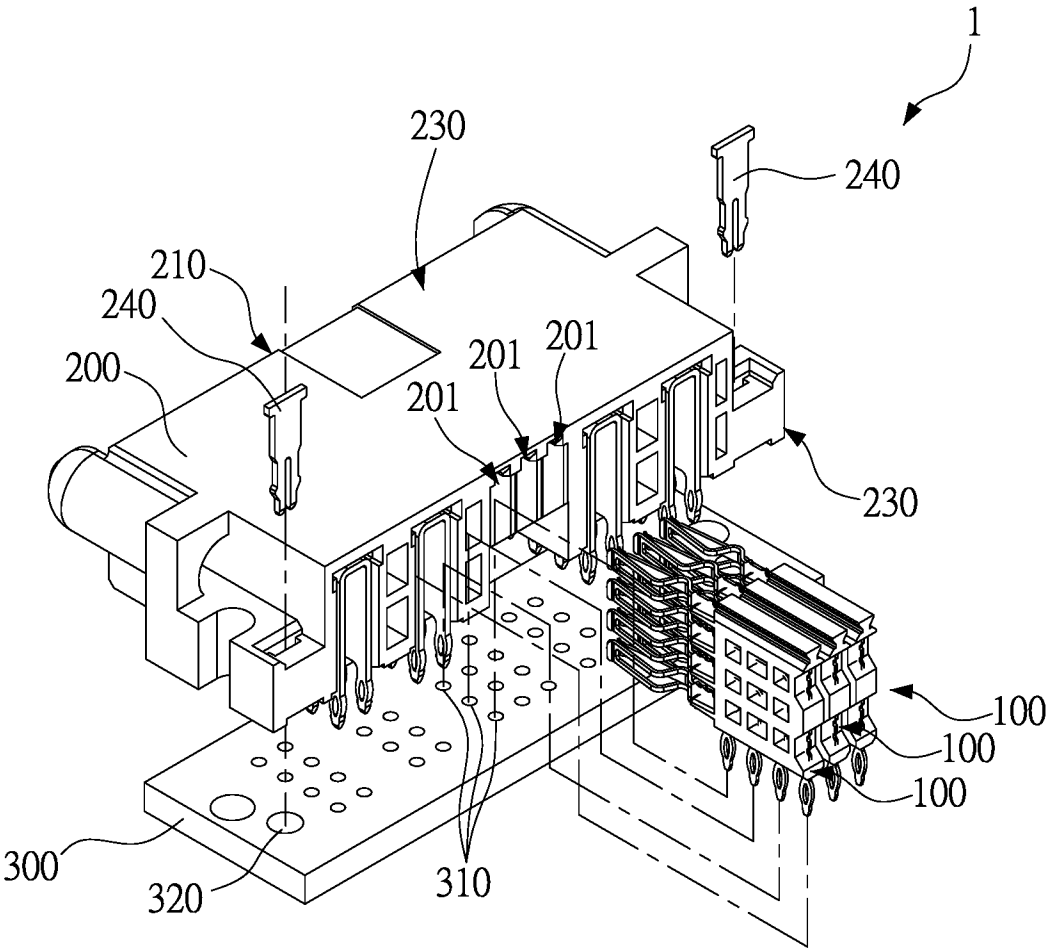
FIG. 1 illustrates an exploded view of an electrical connector according to a first embodiment of this disclosure.
Figure 2:
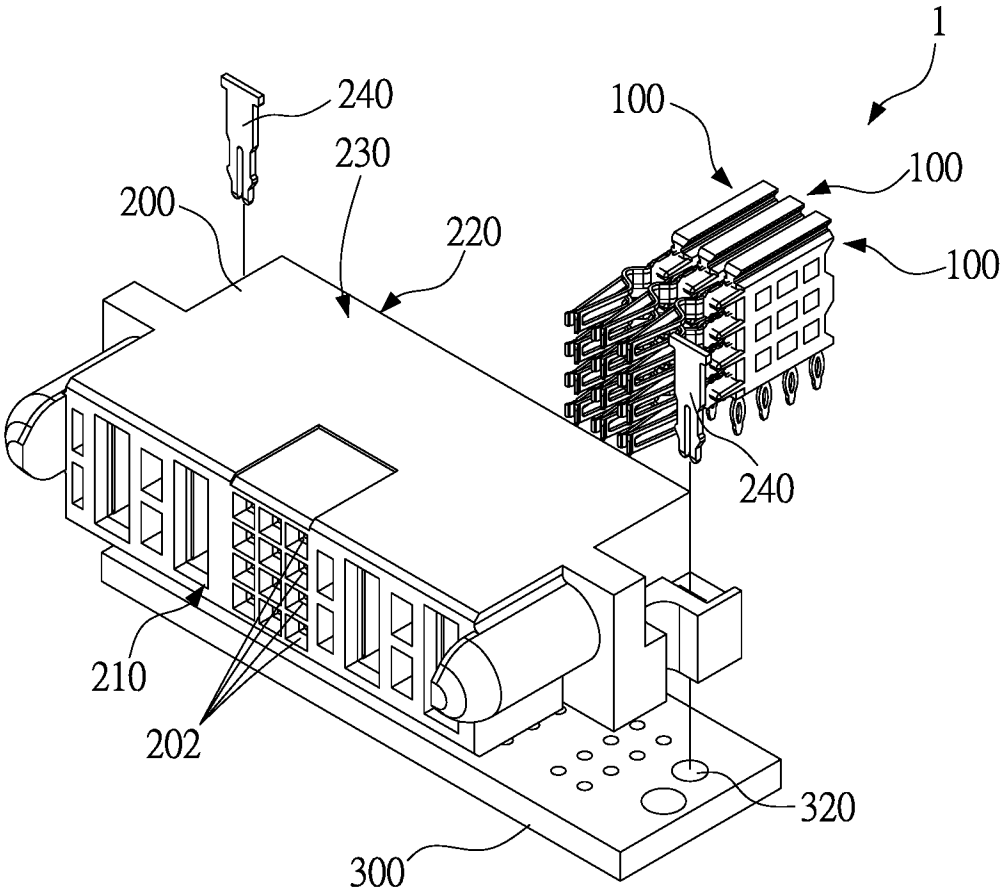
FIG. 2 illustrates another exploded view of the electrical connector according to the first embodiment.
Figure 3:
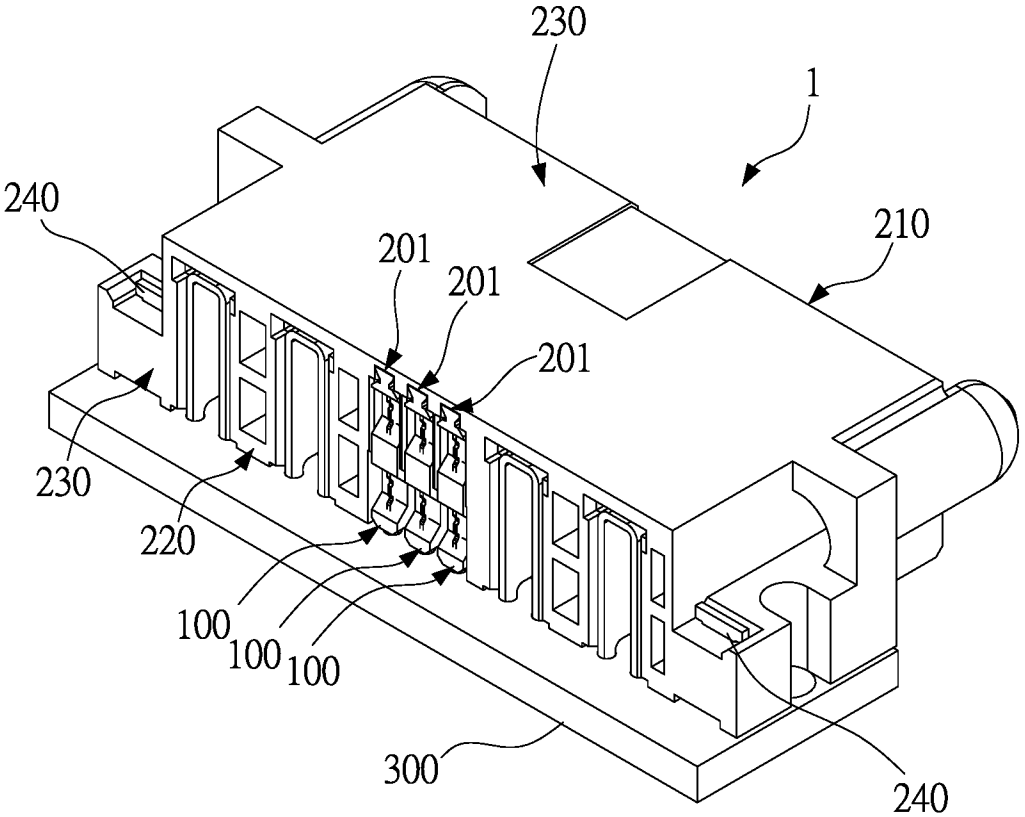
FIG. 3 illustrates a perspective view of the electrical connector according to the first embodiment.

Please refer to FIGS. 1, 2, and 3, an electrical terminal 100 according to a first embodiment of this disclosure is illustrated. The electrical terminal assembly 100 is adapted to be combined with a base 200 to form an electrical connector 1.

Figure 5:
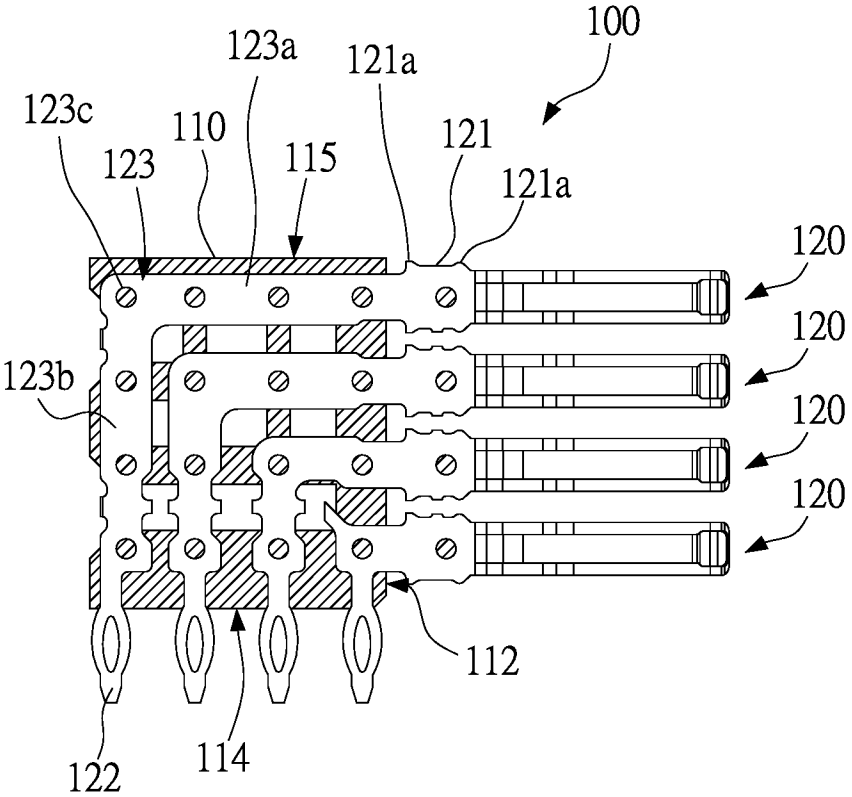
FIG. 5 illustrates a cross-sectional view of the electrical terminal assembly according to the first embodiment.
Figure 4:
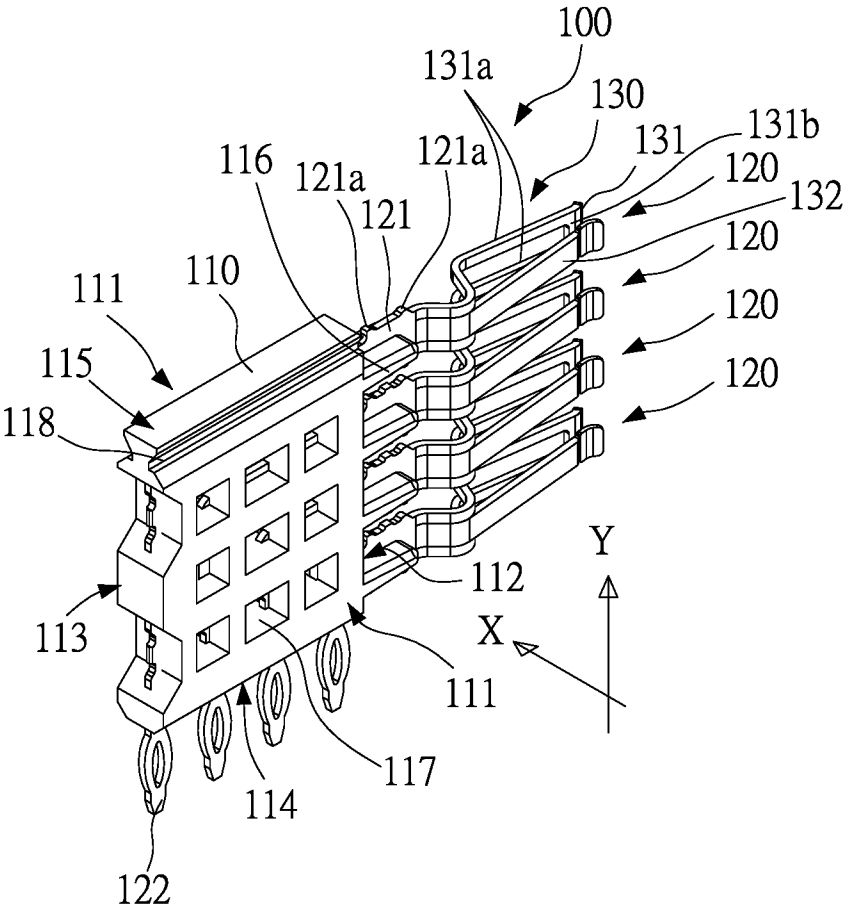
FIG. 4 illustrates a perspective view of an electrical terminal assembly according to the first embodiment.

As shown in FIGS. 4 and 5, the electrical terminal assembly 100 comprises a mounting block 110 and at least one electrical terminal 120. The electrical terminal 120 is partially embedded in the mounting block 110, and the rest of the electrical terminal 120 is exposed out of the mounting block 110.

As shown in FIGS. 4 and 5, the mounting block 110 includes two lateral surfaces 111, a front end 112, a rear end 113, a bottom portion 114, and a top portion 115. The two lateral surfaces 111 are opposite to each other, the front end 112 and the rear end 113 are opposite to each other, and the bottom portion 114 and the top portion 115 are opposite to each other. Specifically, in one embodiment, the mounting block 110 is made of an electrically insulated material, such as plastics. The mounting block 110 may be a single block, which is manufactured by molding injection or other methods to partially enclose the electrical terminal 120. Alternatively, the mounting block 110 may be a combination of plural blocks, and the electrical terminal 120 are partially sandwiched between the plural blocks, so that the electrical terminal 120 is partially embedded in the mounting block 110.

As shown in FIGS. 4 and 5, the electrical terminal 120 includes a terminal body 123, a first exposed section 121, and a second exposed section 122. The terminal body is embedded in the mounting block 110, and located between the two lateral surfaces 111. The first exposed section 121 and the second exposed section 122 are extended from the terminal body 123 and protruding from the mounting block 110. In the first embodiment, an included angle is defined between the first exposed section 121 and the second exposed section 122, that is, the first exposed section 121 and the second exposed section 122 extend outward from the mounting block 110 in different directions for different electrical connection operations. Moreover, the first exposed section 121 further includes an interference part 121*a* protruding from one side edge of the first exposed section 121, and a protruding direction of the interference part 121*a* is substantially perpendicular to an extension direction of the first exposed section 121. The terminal body 123 is provided with one or more apertures 123*c* and a portion of the mounting block 110 extends into the aperture 123*c* to improve the fixation effect on the terminal body 123.

As shown in FIG. 5, the terminal body 123 further comprises a first conduction section 123*a* and a second conduction section 123*b*. The first conduction section 123*a* and the second conduction section 123*b* are connected to each other, and an included angle is defined between the first conduction section 123*a* and the second conduction section 123*b*, so that the first conduction section 123*a* extends toward the front end 112 and the second conduction section 123*b* extends toward the bottom portion 114. The included angle between the first conduction section 123*a* and the second conduction section 123*b* can be arranged as 90 degrees, so that the first conduction section 123*a* is in parallel to the top portion 115 and the second conduction section 123*b* is perpendicular to the top portion 115.

Moreover, the terminal body 123, the first exposed section 121, and the second exposed section 122 may be made of metal sheets. The terminal body 123, the first exposed section 121, and the second exposed section 122 may be integrally formed as a one piece member. The first conduction section 123*a* and the second conduction section 123*b* of the terminal body 123 are sheets having a coplanar configuration, and the hypothesis plane, where the first conduction section 123*a* and the second conduction section 123*b* are located at, is in parallel to the two lateral surfaces 111. The first exposed section 121 is connected to the first conduction section 123*a* and protrudes from the front end 112. The second exposed section 122 is connected to the second conduction section 123*b* and protrudes from the bottom portion 114. The first exposed section 121 and the second exposed section 122 may be sheets, or may be configured as desired shapes according to requirements. The interference part 121*a* protrudes from the edge of the first exposed section 121 and is coplanar with the first conduction section 123*a* and the second conduction section 123*b*.

Specifically, in one embodiment, one electrical terminal assembly 100 may include plural electrical terminals 120, which are in L-shaped configurations and the electrical terminals 120 with gradually reduced sizes are arranged in the order of size. It is understood that, in other embodiments, the electrical terminal 120 may be of a linear configuration without bending structures, so that the first exposed section 121 and the second exposed section 122 extend from the terminal body 123 in opposite directions. Therefore, the electrical terminal 120 are not connected with each other, instead, the first conduction sections 123*a* are in parallel to each other and the second conduction sections 123*b* are in parallel to each other. Therefore, the first exposed sections 121 protrude in parallel from the front end 112 of the mounting block 110, and the second exposed section 122 protrude in parallel from the bottom portion 114 of the mounting block 110.

Figure 6:
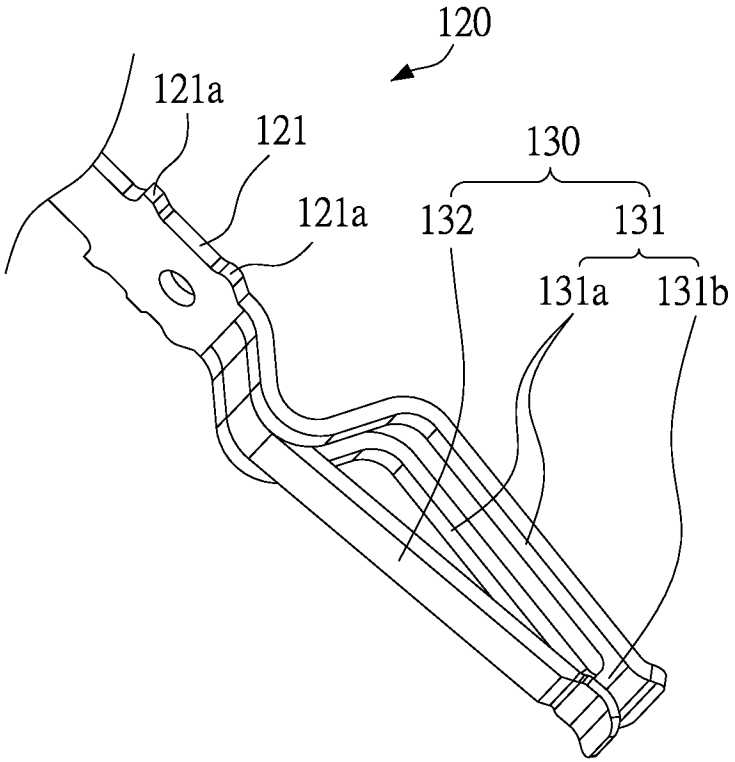
FIG. 6 illustrates a partial perspective view of an electrical terminal according to the first embodiment.

As shown in FIGS. 4, 5, and 6, in the first embodiment, the electrical terminal assembly 100 further comprises a contact part 130 connected to the first exposed section 121. The contact part 130 includes a first clamping piece 131 and a second clamping piece 132. A clamping space is defined between the first clamping piece 131 and the second clamping piece 132 for the insertion of an external terminal to form two contact points.

As shown in FIG. 6, in the first embodiment, the first clamping piece 131 includes two clamping arms 131*a* and a connecting piece 131*b*. The two clamping arms 131*a* are extended from the first exposed section 121, a middle of each of the two clamping arms 131*a* includes a bent portion, and the connecting piece 131*b* is connected to front tips of the two clamping arms 131*a*. The second clamping piece 132 is extended from the first exposed section 121 and located between the two clamping arms 131*a* of the first clamping piece 131. Recesses of the bent portions of the two clamping arms face toward the second clamping piece 132, so that the clamping space is defined. Meanwhile, the connecting piece 131*b* is normally spaced from the second clamping piece 132. The connecting piece 131*b* is inclined outwardly with respect to the second clamping piece 132, so that a clamping groove opened outwardly is defined between the connecting piece 131*b* and the second clamping piece 132. The clamping groove is provided for guiding the external terminal to be inserted into a space between the connecting piece 131*b* and the second clamping piece 132 and further enter into the clamping space.

As shown in FIGS. 4 and 5, in one embodiment, the mounting block 110 does not necessarily enclose the terminal body 123 completely. The mounting block 110 may include one or more hollow holes 117 defined through the two lateral surfaces 111, so that the terminal body 123 (i.e., the first conduction sections 123*a* and the second conductive section 123*b*) can be partially exposed through the hollow holes 117. Accordingly, the hollow holes 117 reduce the volume of the mounting block 110, thereby reducing the material required for making the mount block 110 and the weight of the mounting block 110.

As shown in FIGS. 1, 2, and 3, the base 100 includes a front surface 210, a rear surface 220, and an outer peripheral surface 230. The front surface 230 is opposite to the rear surface 220, and the outer peripheral surface 230 is connected to the front surface 210 and the rear surface 220. The outer peripheral surface 230 may be a single continuous curved surface, or may be formed by connecting a plurality of planes and curved surfaces. One or more installation troughs 201 are on the rear surface 220 for inserting the electrical terminal 120 therein, and each of the installation troughs 201 is in communication with the front surface 210 through one insertion hole 202.

Figure 7:
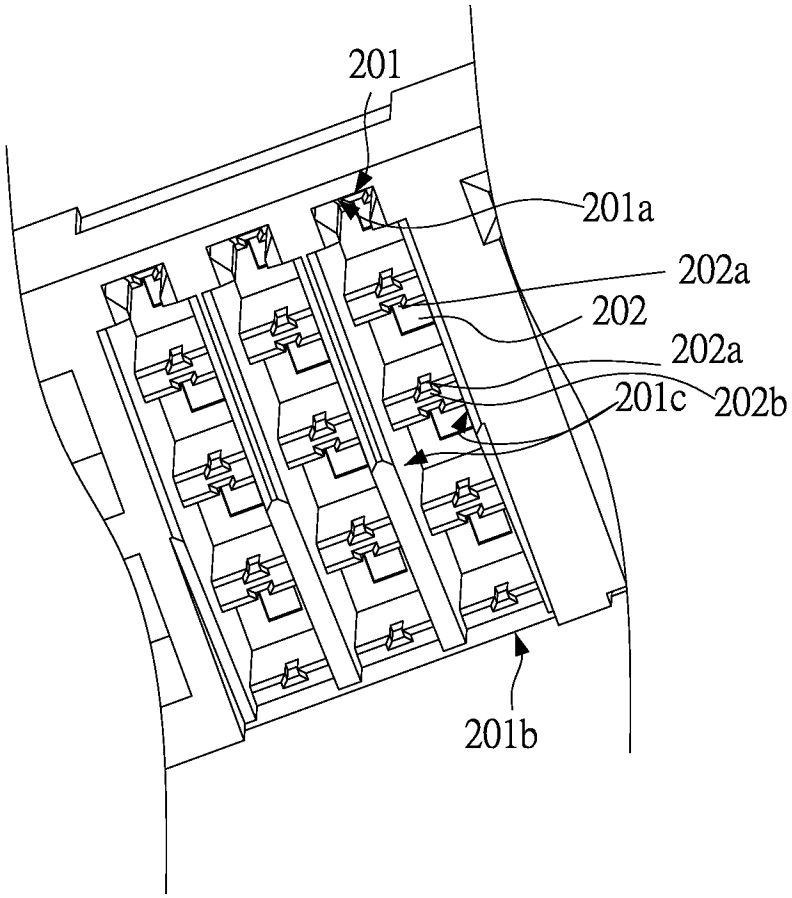
FIG. 7 illustrates a perspective partial sectional view of a base of the electrical connector according to the first embodiment.
Figure 8:
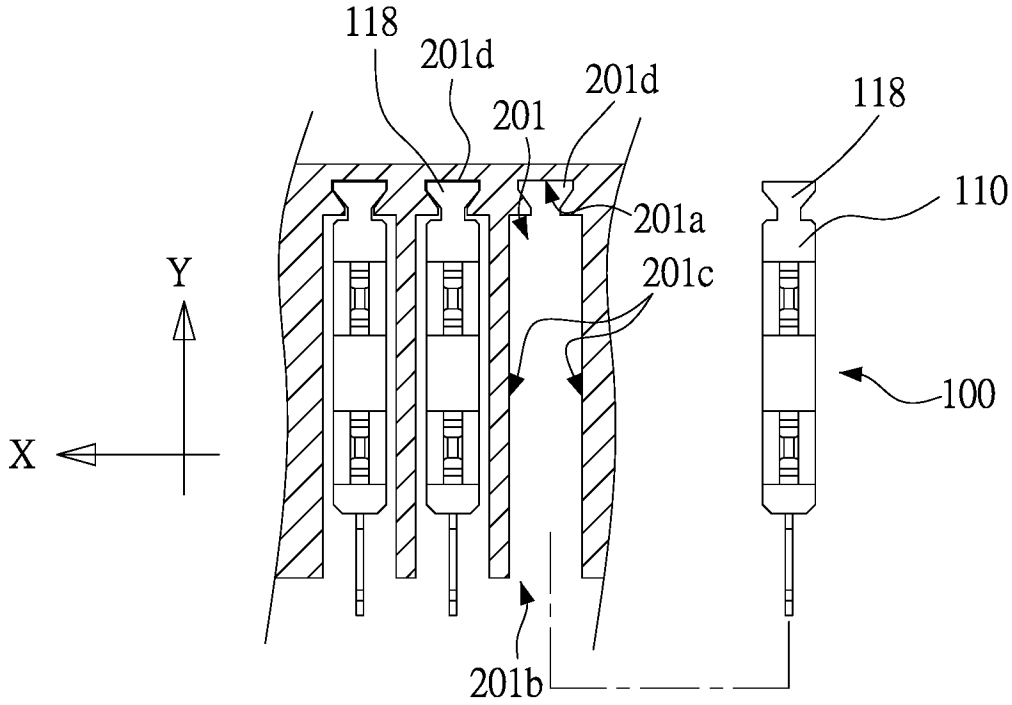
FIG. 8 illustrates a partial cross-sectional view of the base and the electrical terminal assembly according to the first embodiment.

As shown in FIGS. 7 and 8, the shape of the installation trough 201 matches the shape of the mounting block 110, so that the mounting block 110 can be installed in the installation trough 201. The installation trough 201 includes an upper wall surface 201*a*, a lateral opening 201*b*, and two lateral wall surfaces 201*c*. The two lateral wall surfaces 201*c* are connected to the upper wall surface 201*a* and the lateral opening 201*b*. A distance between the two side walls 201*c* is equal to or greater than a distance between the two lateral surfaces 111 of the mounting block 110. The lateral opening 201*b* communicates with the outer peripheral surface 230, so that the installation trough 201 is also opened on the outer peripheral surface 230. Usually, in one embodiment, the surface where the lateral opening 201*b* is located is the bottom surface of the base 200, and is mounted to a circuit board 300.

Figure 9:
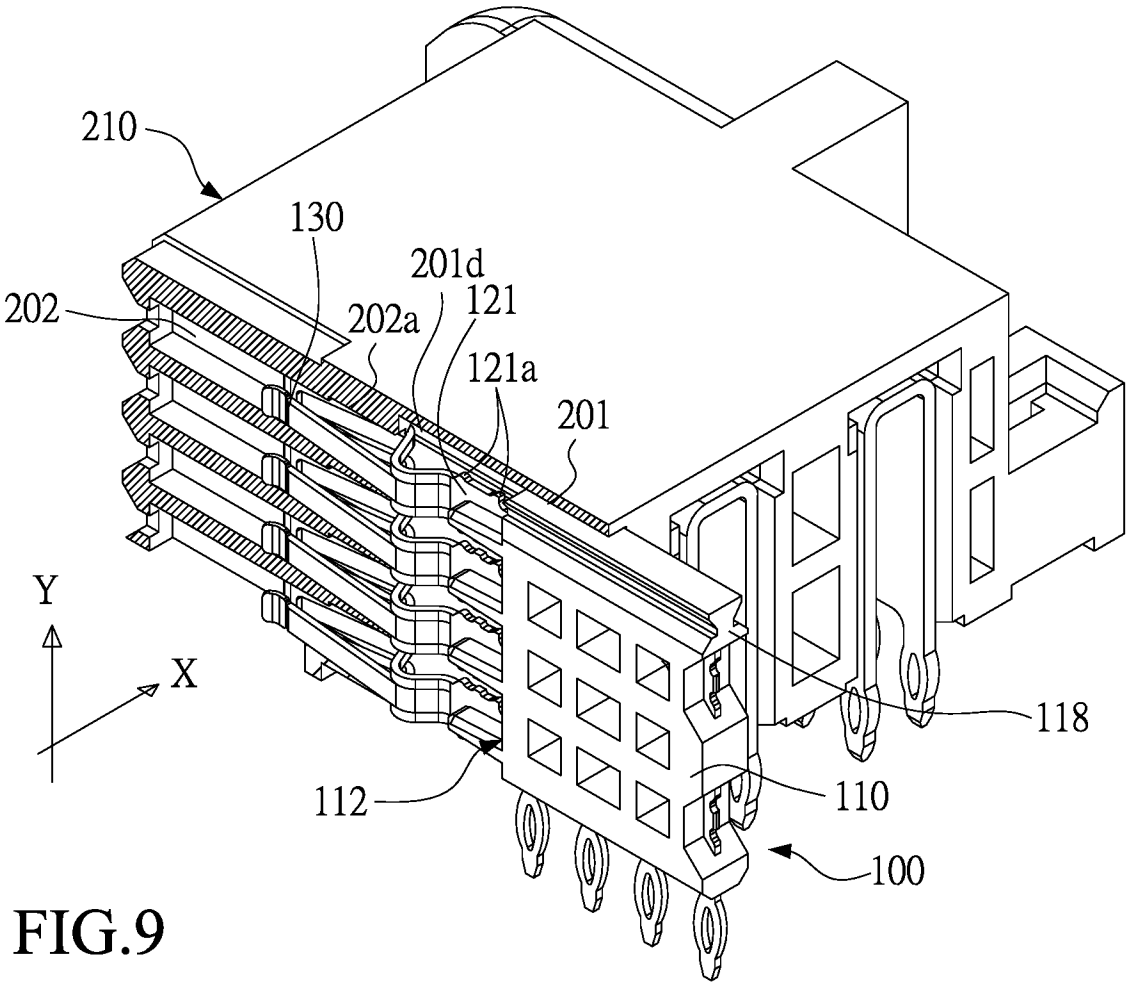
FIG. 9 illustrates a perspective partial sectional view of the electrical connector according to the first embodiment.

As shown in FIGS. 7 and 9, the insertion hole 202 communicates with the front surface 210, and at least one guiding groove 202*a* is provided in the insertion hole 202. The guiding groove 202*a* is extended from a connection portion between the installation trough 201 and the insertion hole 202 toward the front surface 210, so that the guiding groove 202*a* is at least open at the opening edge of the installation trough 201. A guiding bevel 202*b* is disposed at an end of the guiding groove 202*a* corresponding to the installation trough 201.

Figure 10:
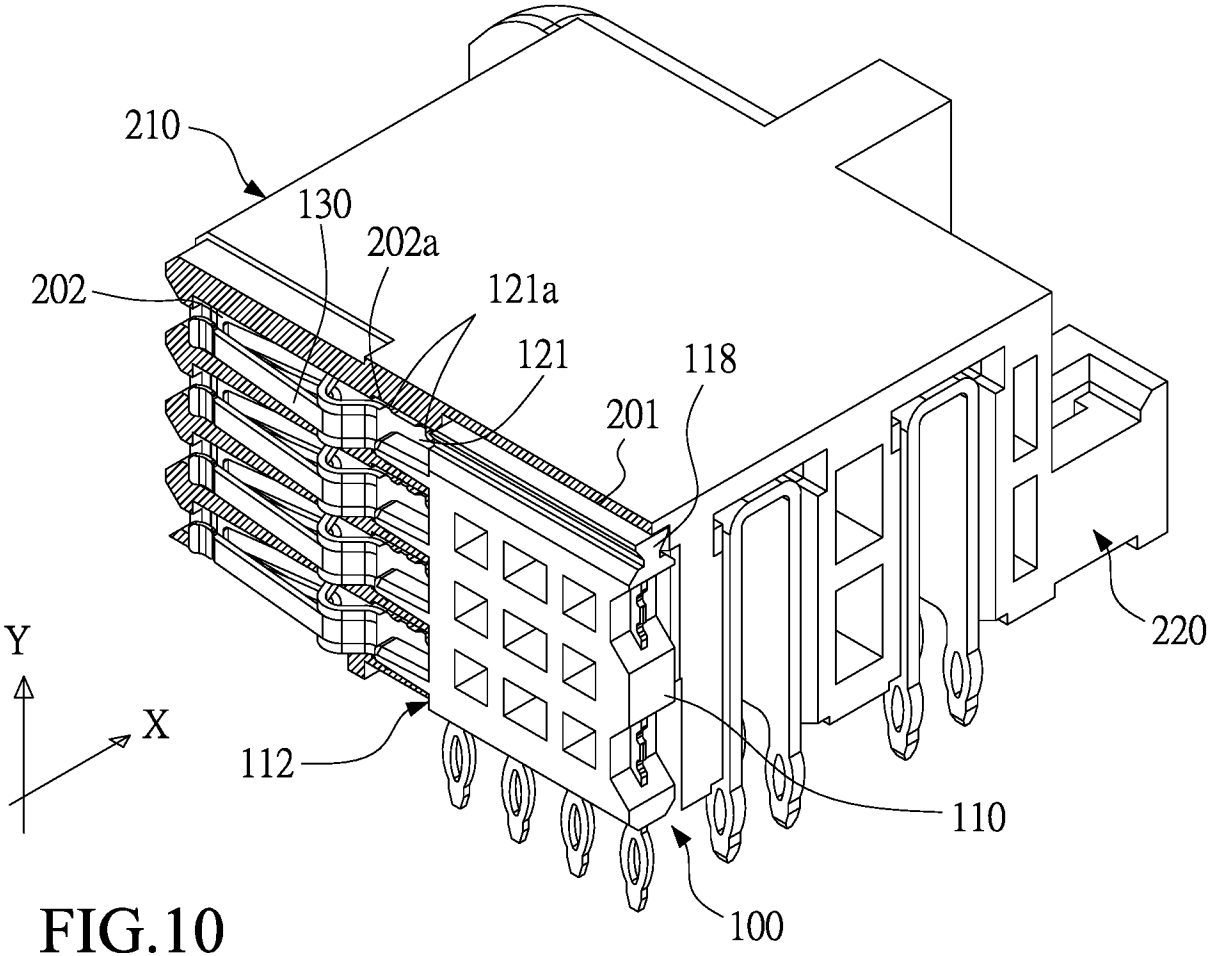
FIG. 10 illustrates another perspective partial sectional view of the electrical connector according to the first embodiment.

As shown in FIGS. 8, 9, and 10, the front end 112 of the mounting block 110 of the electrical terminal assembly 100 is inserted into the installation trough 201. Under this arrangement, the two lateral surfaces 111 correspond to the two lateral wall surfaces 201*c*, the top portion 115 corresponds to the upper wall surface 201*a*, and the bottom portion 114 corresponds to the side groove 201*b*. Next, the first exposed section 121 is inserted into the insertion hole 202, and the interference part 121*a* is embedded into the guiding groove 202*a*. The guiding bevel 202*b* is configured to guide the interference part 121*a* to slide into the guiding groove 202*a*. Provide a height direction Y defined as a direction from the bottom portion 114 to the top portion 115 and a horizontal direction X defined as a direction connecting the two lateral surfaces 111 with each other, the combination of the interference part 121*a* and the guiding groove 202*a* limit the first exposed section 121 in the horizontal direction X to prevent the electrical terminal assembly 100 from shaking in the horizontal direction X. The depth of the guiding groove 202*a* is parallel to the height direction Y. A height of the interference part 121*a* of the first exposed section 121 in the height direction Y is greater than a summation of a depth of the guiding groove 202*a* in the height direction Y and a height of the insertion hole 202 in the height direction Y, so that the combination of the interference part 121*a* and the guiding groove 202*a* can have a tight-fitting effect to limit the first exposed section 121 in the height direction Y. Moreover, the tight-fitting effect produces a fixation effect on the first exposed section 121, thereby preventing the electrical terminal assembly 100 from being detached off the installation trough 201.

As shown in FIG. 4, in addition, the mounting block 110 further includes an extension portion 116 extended from the front end 112 and partially enclosing the first exposed section 121, so that additional supports can be provided for the first exposed section 121 to avoid bending and deformation of the first exposed section 121. Therefore, as shown in FIG. 6, a width of the insertion hole 202 in the horizontal direction X is greater than or equal to a thickness of the extension portion in the horizontal direction X, so that the extension portion 116 could insert into the insertion hole 202.

As shown in FIGS. 8 and 9, to further achieve the fixation of the electrical terminal assembly 100, the mounting block 110 is provided with a first guiding structure 118, and the installation trough 201 is provided with a second guiding structure 201*d*. The first guiding structure 118 and the second guiding structure 201*d* mate with each other to guide the mounting block 110 to move along the horizontal direction X in the installation trough 201 and to limit the mounting block 110 in the height direction Y. In the first embodiment, the first guiding structure 118 and the second guiding structure 201*d* may be a combination of a dovetail groove and a dovetail seat. For example, the first guiding structure 118 is a dovetail seat provided on the top portion 115 of the mounting block 110, and the second guiding structure 201*d* is a dovetail groove provided on the upper wall surface 201*a*. Alternatively, in another example, the first guiding structure 118 is a dovetail groove provided on the top portion 115 of the mounting block 110, and the second guiding structure 201*d* is a dovetail seat provided on the upper wall surface 201*a*.

In other word, in one embodiment, the aforementioned first guiding structure 118 and the second guiding structure 201*d* can also be regarded as a combination of a slide groove and a slide rail, which are respectively disposed on the two lateral surfaces 111 of the mounting block 110 and the two lateral wall surfaces 201*c* of the installation trough 201. Under this arrangement, the slide groove and a slide rail do not necessarily be provided at the top portion 115 of the mounting block 110 and the upper wall surface 201*a* of the mounting groove 201, but may be provided at middle positions of the two lateral surfaces 111 and middle portions of the two lateral wall surfaces 201*c*.

As shown in FIGS. 1, 2, 3, 4, and 5, the base 200 and the electrical terminal 120 can be further fixed on a circuit board 300. The circuit board 300 includes plural through holes 310 and fixing holes 320. The through holes 310 correspond to the second exposed section 122 of the electrical terminal 120. In one or more embodiment, the second exposed section 122 may be a press-fit pin inserted into one through hole 310 and soldered on the circuit board 300. In some embodiments, the press-fit pin is directly inserted into the through hole 310 without soldering process. Alternatively, the through holes 310 are omitted and the second exposed section 122 may be a soldering pin directly soldered on the circuit board 300 to fix the electrical terminal 120 on circuit board 300. The fixing holes 320 correspond to a fixing structure 240 of the base 200. The fixing structure 240 is used to be inserted into the fixing hole 320 to fix the base 200 on the circuit board 300. The fixing structure 240 may be a post integrally formed on the outer peripheral surface 230 of the base 200, or may be a fixing pin inserted into the fixing hole 320 through the base 200. In one embodiment, the second exposed section 122 may also be omitted, and the terminal body 123 is connected directly with a cable (the front section of the cable is enclosed in the mounting block 110) or the first exposed section 121 is connected with a cable. Under these configurations, the through holes 310 can be omitted.

Plural electrical terminals 120 can be combined into one single electrical terminal assembly 100 by enclosing the plural electrical terminals 120 in the mounting block 110, so that the electrical terminals 120 can be quickly installed in the base 200. Moreover, the mounting block 110 provides the supporting and the fixation for the electric terminals 120, so that the deformation of the electrical terminal 120 can be prevented, and the first exposed section 121 or the second exposed section 122 can be prevented from being displaced. Therefore, the second exposed sections 122 can be easily aligned with the through holes 310 and inserted into the through holes 310. Therefore, problems that the individual second exposed sections 122 cannot be aligned with the through holes 310 due to deformation where the second exposed sections 122 cannot be inserted into the corresponding through holes 310 can be avoided.

Figure 11:
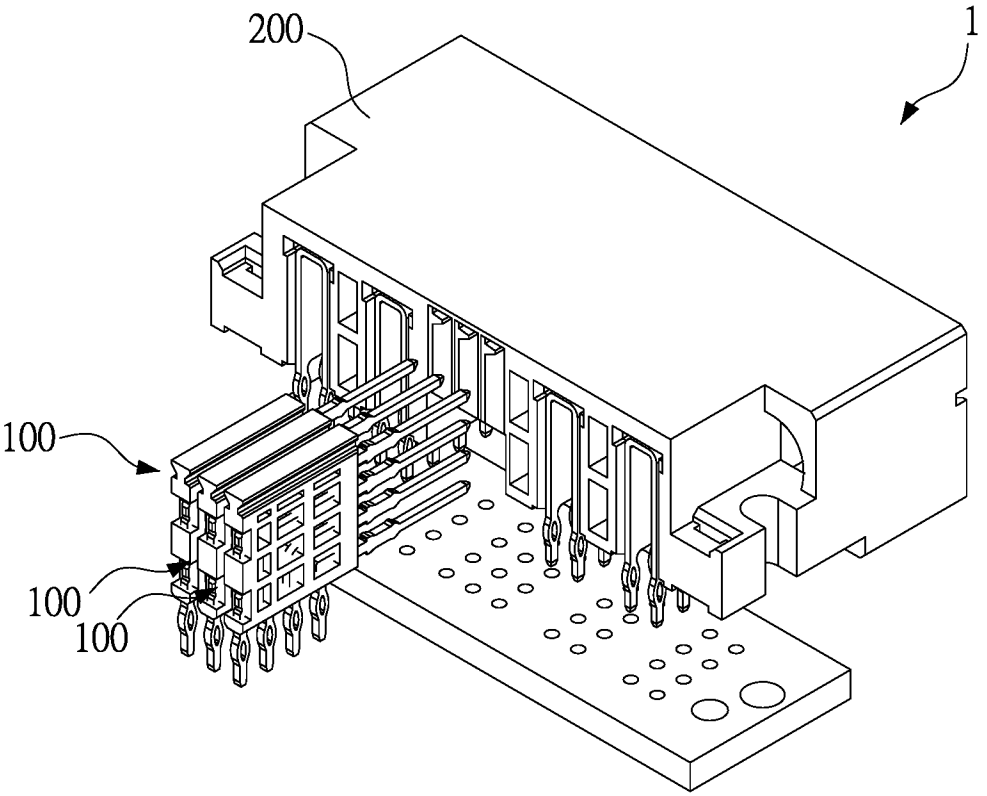
FIG. 11 illustrates an exploded view of an electrical connector according to a second embodiment of this disclosure.
Figure 12:
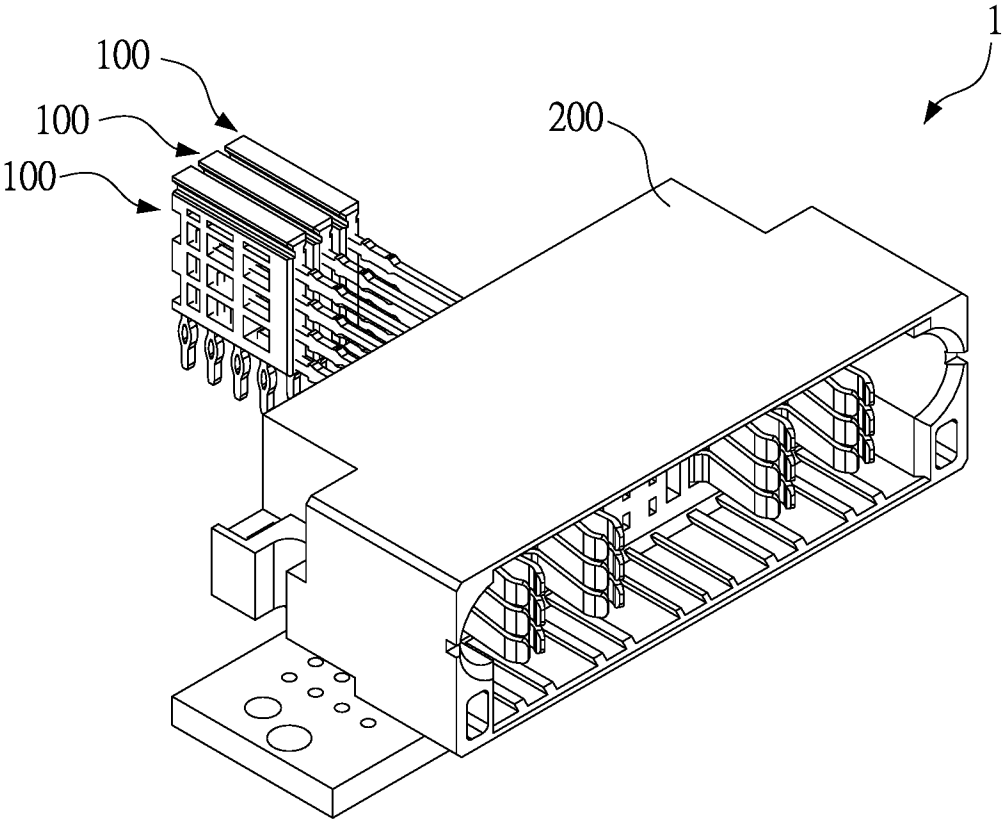
FIG. 12 illustrates another exploded view of the electrical connector according to the second embodiment.
Figure 13:
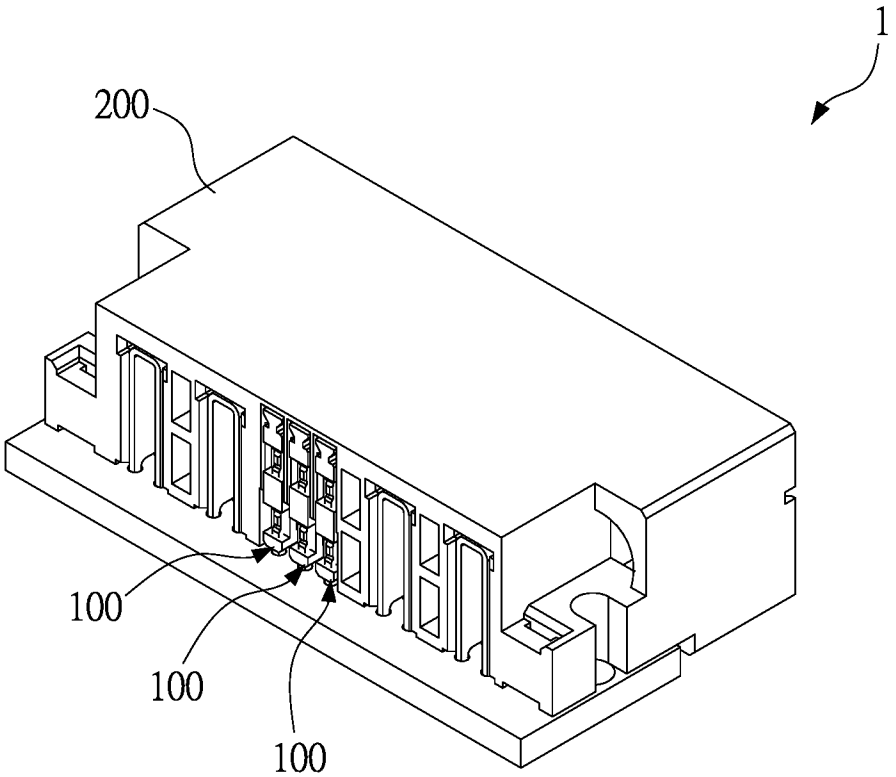
FIG. 13 illustrates a perspective view of the electrical connector according to the second embodiment.

As shown in FIGS. 11, 12, and 13, an electrical connector 1 according to a second embodiment of this disclosure is illustrated. The electrical connector 1 comprises at least one electrical terminal assembly 100 and the base 200.

Figure 14:
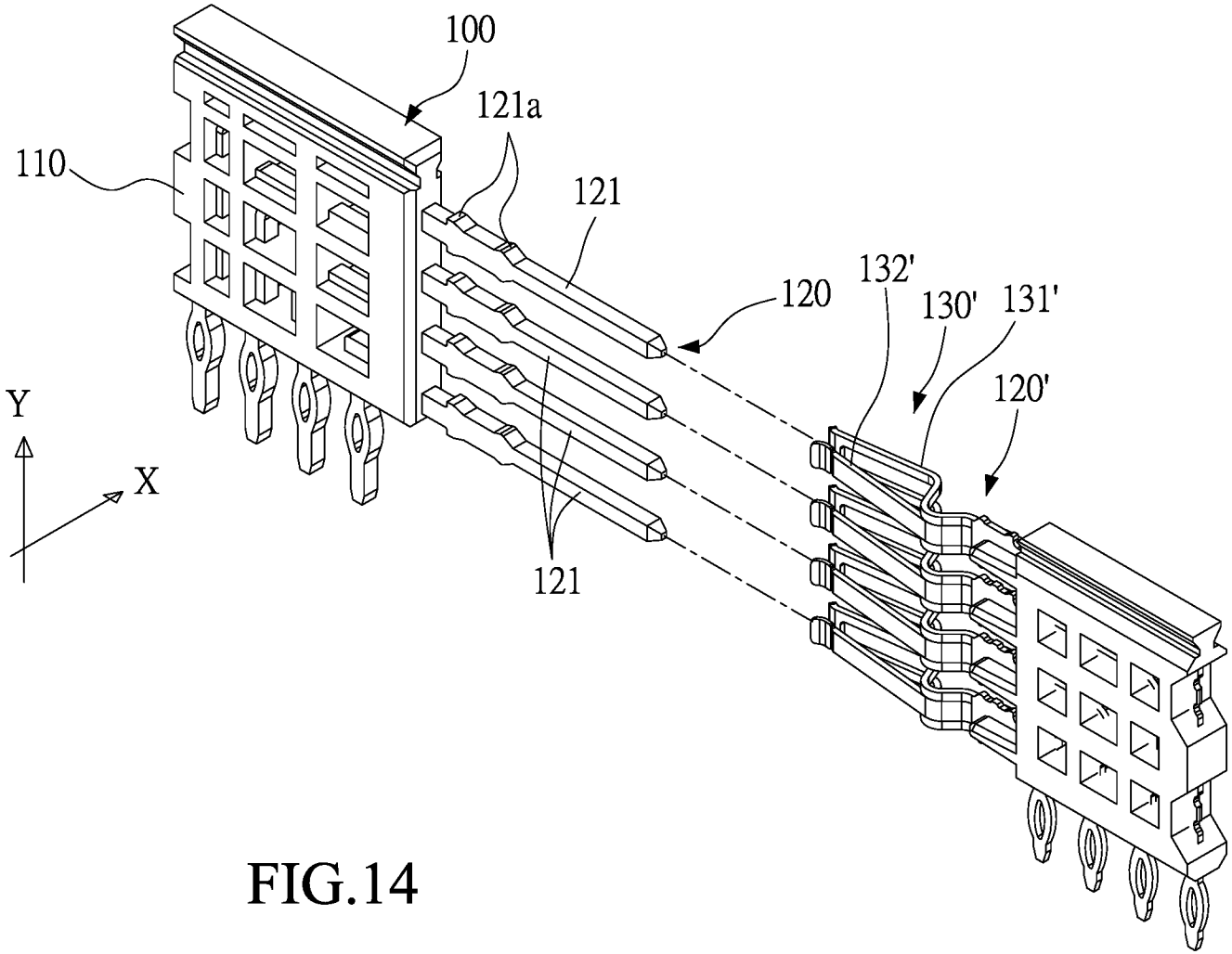
FIG. 14 illustrates a perspective view of the electrical terminal assembly and external terminals according to the second embodiment.
Figure 15:
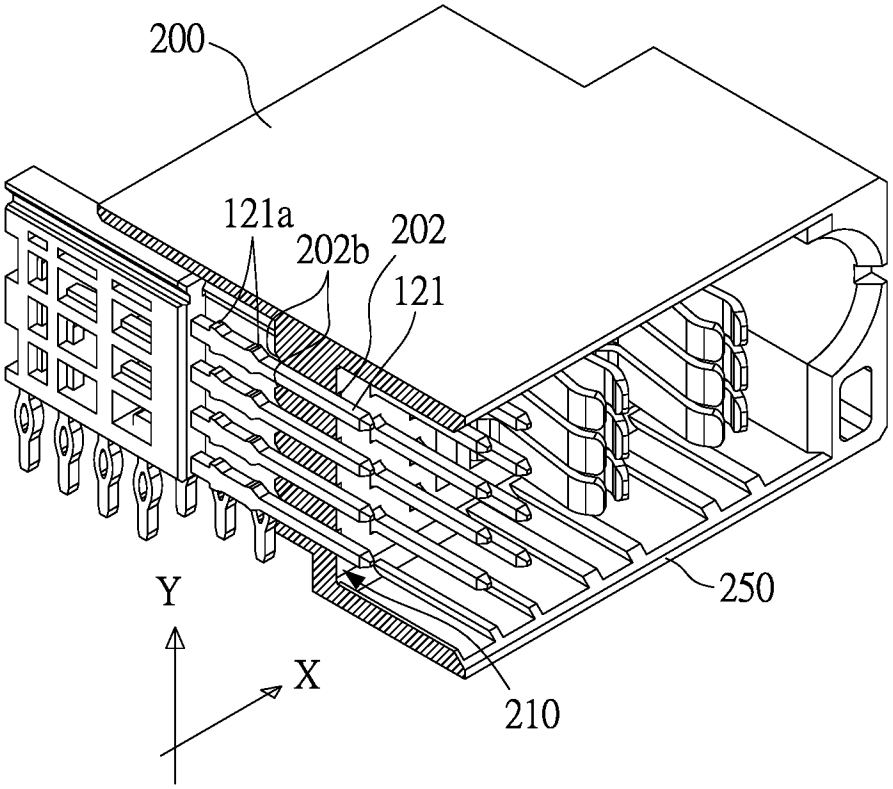
FIG. 15 illustrates a perspective partial sectional view of the electrical connector according to the second embodiment.
Figure 16:
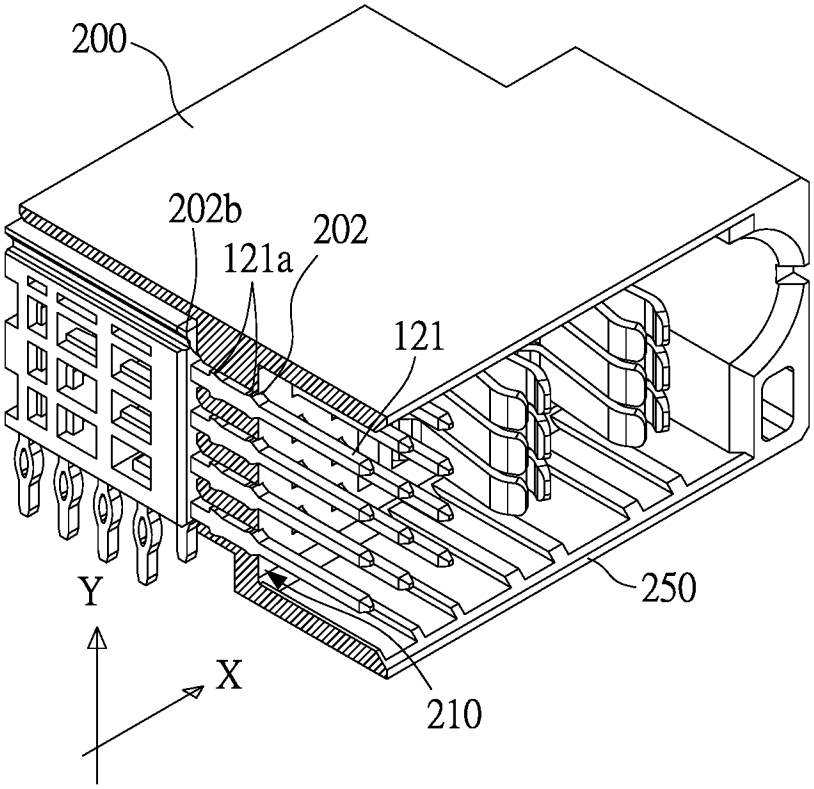
FIG. 16 illustrates another perspective partial sectional view of the electrical connector according to the second embodiment.
Figure 17:
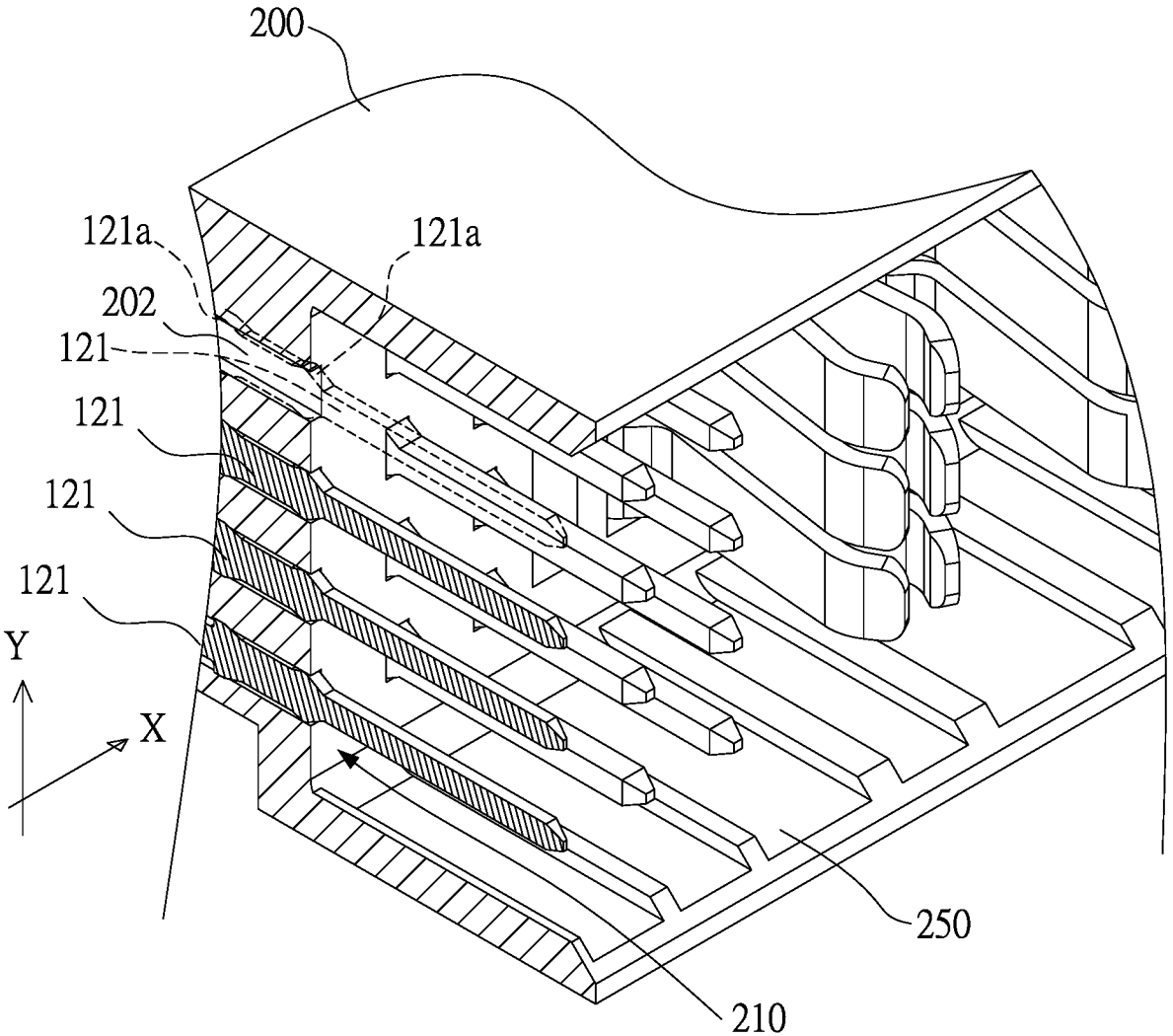
FIG. 17 illustrates still another perspective partial sectional view of the electrical connector according to the second embodiment.

As shown in FIGS. 14, 15, 16, and 17, most of the features of the electrical terminal assembly 100 is the same as that of the first embodiment, and some of the differences between the two embodiments are described below. In the first embodiment (as shown in FIG. 10), the first exposed section 121 and the contact part 130 are located in the insertion hole 202 without protruding from the front surface 210. In the second embodiment (as shown in FIG. 15 and FIG. 16), the first exposed section 121 further passes through the insertion hole 202 and protrudes from the front surface 210 to contact an external terminal 120'. Moreover, in the second embodiment, the edges of the front face 210 form a surrounding side retaining wall 250. The space surrounded by the side retaining wall 250 is used for receiving another electrical connector 1, such as the electrical connector 1 described in the first embodiment. The front surface 210 of the electrical connector 1 according to the first embodiment can be inserted into the space surrounded by the side retaining wall 250. Moreover, the first exposed section 121 can be further inserted into the insertion hole 202 of another electrical connector 1 to contact the external terminal 120'.

As shown in FIGS. 14, 15, 16, and 17, in the second embodiment, the extension portion 116 is omitted. Under this arrangement, the width of the insertion hole 202 in the horizontal direction X can just be configured to match the thickness of the first exposed section 121 in the horizontal direction X, so that the first exposed section 121 can be limited in the horizontal direction X. Moreover, the insertion hole 202 can be devoid of the guiding groove. The interference part 121*a* protrudes from the edge of the first exposed section 121 in the height direction Y, and a height of the first exposed section 121 at the portion where the interference part 121*a* is located in the height direction Y may be greater than or equal to a height of the insertion hole 202 in the height direction Y. Therefore, the interference part 121*a* is pressed against the inner wall of the insertion hole 202, and the inner wall of the insertion hole 202 and/or the interference part 121*a* are slightly deformed. Accordingly, the combination of the interference part 121*a* and the insertion hole 202 can have a tight-fitting effect so as to limit the first exposed section 121 in the height direction Y. Moreover, the tight-fitting effect produces a fixation effect on the first exposed section 121, thereby preventing the electrical terminal assembly 100 from being detached off the installation trough 201. Furthermore, in the second embodiment, the guiding bevel 202*b* is disposed at one end of the insertion hole 202 connected to the installation trough 201, so that the guiding bevel can guide the first exposed section 121 and the interference part 121*a* entering into the insertion hole 202.

As shown in FIG. 14, the electrical terminal 120 and the external terminal 120' of the second embodiment (i.e., the electrical terminal 120 of the first embodiment) correspond to each other. The clamping groove at the front tip of the external terminal 120' facilitates the first exposed section 121 to be guided and inserted into the contact part 130'. Therefore, the external terminal 120' is clamped by the first clamping piece 131' and the second clamping piece 132' to form a proper contact to achieve electrical connection.

In one or more embodiments of this disclosure, plural electrical terminals 120 are combined together by the mounting block 110 to form the electrical terminal assembly 100. The electrical terminal assembly 100 can be used for the installation of plural electrical terminals 120 in the base 200 at one time. Moreover, the configuration of the interference part is helpful to guide, limit, and fix the first exposed section 121 of the electrical terminal 120 in the insertion hole 202, thereby facilitating the fixation of the electrical terminal assembly 100. Furthermore, in one or more embodiments, the mounting block 110 and the base 200 are combined with each other through a guiding structure, so that the fixation of the electrical terminal assembly 100 in the electrical connector 1 can be further improved. The mounting block 110 provides a fixing and supporting effect on the electrical terminals 120, effectively avoiding the deformation of the electrical terminals 120, and helpful for subsequent alignment of the electrical terminals 120 and the through holes 310 when the electrical connector 1 is installed on the circuit board 300.

What is claimed is:

1. An electrical terminal assembly, comprising:

a mounting block;

at least one electrical terminal including a terminal body and a first exposed section;

wherein the terminal body is embedded in the mounting block, the first exposed section is extended from the terminal body and protruding from the mounting block, the first exposed section further includes an interference part protruding from one side edge of the first exposed section, and a protruding direction of the interference part is substantially perpendicular to an extension direction of the first exposed section; and a contact part connected to the first exposed section;

wherein the contact part includes a first clamping piece and a second clamping piece, and a clamping space is defined between the first clamping piece and the second clamping piece; and wherein the first clamping piece includes two clamping arms and a connecting piece, the two clamping arms are extended from the first exposed section, and a middle of each of the two clamping arms includes a bent portion, the connecting piece is connected to front tips of the two clamping arms, the second clamping piece is extended from the first exposed section and located between the two clamping arms, and recesses of the bent portions of the two clamping arms face toward the second clamping piece.

2. The electrical terminal assembly as claimed in claim 1, wherein the at least one electrical terminal further includes a second exposed section, and the second exposed section is extended from the terminal body.

3. The electrical terminal assembly as claimed in claim 2, wherein an included angle is defined between the first exposed section and the second exposed section.

4. The electrical terminal assembly as claimed in claim 2, wherein the mounting block includes two lateral surfaces, a front end, a rear end, a bottom portion, and a top portion; the two lateral surfaces are opposite to each other, the rear end and the front end are opposite to each other, and the bottom portion and the top portion are opposite to each other; the terminal body is located between the two lateral surfaces, and the first exposed section protrudes from the front end.

5. The electrical terminal assembly as claimed in claim 4, wherein the terminal body comprise a first conduction section and a second conduction section, the first conduction section and the second conduction section are connected to each other, and an included angle is defined between the first conduction section and the second conduction section; wherein the first exposed section is connected to the first conduction section and the second exposed section is connected to the second conduction section.

6. The electrical terminal assembly as claimed in claim 5, wherein the first conduction section extends toward the front end, and the second conduction section extends towards the bottom portion.

7. The electrical terminal assembly as claimed in claim 1, wherein the terminal body includes at least one aperture, and a portion of the mounting block extends into the at least one aperture.

8. The electrical terminal assembly as claimed in claim 1, wherein the connecting piece is normally spaced from the second clamping piece, and the connecting piece is inclined outwardly with respect to the second clamping piece, so that a clamping groove opened outwardly is defined between the connecting piece and the second clamping piece.

9. The electrical terminal assembly as claimed in claim 1, wherein the mounting block further comprise at least one extension portion partially encloses the first exposed section.

10. An electrical connector, comprising:

a base, including a front surface, a rear surface, and an outer peripheral surface, wherein the front surface is opposite to the rear surface, and the outer peripheral surface is connected to the front surface and the rear surface; at least one installation trough is on the rear surface and the at least one installation trough communicates with the front surface through an insertion hole; wherein at least one guiding groove is arranged in the insertion hole, and the at least one guiding groove is extended toward the front surface from a connection portion between the at least one installation trough and the insertion hole; and an electrical terminal assembly, including:

a mounting block including two lateral surfaces, a front end, a rear end, a bottom portion, and a top portion, wherein the two lateral surfaces are opposite to each other, the rear end and the front end are opposite to each other, and the bottom portion and the top portion are opposite to each other; and at least one electrical terminal including a terminal body and a first exposed section, wherein the terminal body is embedded in the mounting block, the first exposed section is extended from the terminal body and protruding from the mounting block, wherein the first exposed section further includes an interference part protruding from one side edge of the first exposed section, and a protruding direction of the interference part is substantially perpendicular to an extension direction of the first exposed section; wherein the mounting block is received in the at least one installation trough, the first exposed section is inserted into the insertion hole, and the interference part is embedded into the guiding groove;

wherein providing a height direction defined as a direction from the bottom portion to the top portion and a horizontal direction defined as a direction connecting the two lateral surfaces with each other, the interference part protrudes from the edge of the first exposed section in the height direction, and a height of the interference part of the first exposed section is greater than a summation of a depth of the guiding groove in the height direction and a height of the insertion hole in the height direction.

11. The electrical connector as claimed in claim 10, wherein the electrical terminal further includes a second exposed section, and the second exposed section is extended from the terminal body.

12. The electrical connector as claimed in claim 11, wherein the terminal body is located between the two lateral surfaces, and the first exposed section protrudes from the front end; and the at least one installation trough includes an upper wall surface, a lateral opening, and two lateral wall surfaces, and the two lateral wall surfaces are connected to the upper wall surface and the lateral opening; a distance between the two lateral walls is equal to or greater than a distance between the two lateral surfaces of the mounting block, and the front end of the mounting block of the electrical terminal assembly is inserted into the at least one installation trough, so that the two lateral surfaces correspond to the two lateral wall surfaces, the top portion corresponds to the upper wall surface, the bottom portion corresponds to the lateral opening, and the second exposed section is exposed from the outer peripheral surface through the lateral opening.

13. The electrical connector as claimed in claim 10, wherein the mounting block further includes at least one extension portion extending from the front end and partially encloses the first exposed section, and a width of the insertion hole in the horizontal direction is greater than or equal to a thickness of the extension portion in the horizontal direction.

14. The electrical connector as claimed in claim 10, wherein the mounting block is provided with a first guiding structure, the at least one installation trough is provided with a second guiding structure; the first guiding structure and the second guiding structure mate with each other to guide the mounting block to move along the horizontal direction in the at least one installation trough, and to limit the mounting block in the height direction.

15. An electrical connector, comprising:

a base, including a front surface, a rear surface, and an outer peripheral surface, wherein the front surface is opposite to the rear surface, and the outer peripheral surface is connected to the front surface and the rear surface; at least one installation trough is on the rear surface and the installation trough communicates with the front surface through an insertion hole; and at least one electrical terminal assembly, comprising:

a mounting block including two lateral surfaces, a front end, a rear end, a bottom portion, and a top portion, wherein the two lateral surfaces are opposite to each other, the rear end and the front end are opposite to each other, and the bottom portion and the top portion are opposite to each other; and at least one electrical terminal including a terminal body and a first exposed section, wherein the terminal body is embedded in the mounting block, the first exposed section is extended from the terminal body and protruding from the mounting block, wherein the first exposed section further includes an interference part protruding from one side edge of the first exposed section, and a protruding direction of the interference part is substantially perpendicular to an extension direction of the first exposed section; wherein the mounting block is received in the at least one installation trough, the first exposed section is inserted into the insertion hole, and the interference part is abutted against an inner wall of the insertion hole;

wherein providing a height direction defined as a direction from the bottom portion to the top portion and a horizontal direction defined as a direction connecting the two lateral surfaces with each other, a width of the insertion hole in the horizontal direction corresponds to a thickness of the first exposed section; the interference part protrudes from the edge of the first exposed section in the height direction, and a height of the interference part of the first exposed section is greater than or equal to a height of the insertion hole in the height direction.

16. The electrical connector as claimed in claim 15, wherein the at least one electrical terminal further includes a second exposed section, and the second exposed section is extended from the terminal body.

17. The electrical connector as claimed in claim 16, wherein, the terminal body is located between the two lateral surfaces, and the first exposed section protrudes from the front end; and the at least one installation trough includes an upper wall surface, a lateral opening, and two lateral wall surfaces, and the two lateral wall surfaces are connected to the upper wall surface and the lateral opening; a distance between the two side walls is equal to or greater than a distance between the two lateral surfaces of the mounting block, and the front end of the mounting block of the electrical terminal assembly is inserted into the at least one installation trough, so that the two lateral surfaces correspond to the two lateral wall surfaces, the top portion corresponds to the upper wall surface, the bottom portion corresponds to the lateral opening, and the second exposed section is exposed from the outer peripheral surface through the lateral opening.

18. The electrical connector as claimed in claim 15, wherein the mounting block is provided with a first guiding structure, the at least one installation trough is provided with a second guiding structure; the first guiding structure and the second guiding structure mate with each other to guide the mounting block to move along the horizontal direction in the at least one installation trough, and to limit the mounting block in the height direction.

* * * * *